US005975942A

United States Patent [19]

Roush et al.

[11] Patent Number: 5,975,942

[45] Date of Patent: Nov. 2, 1999

[54] MECHANICAL STRAIN RELIEF

[75] Inventors: Robert A. Roush; Raymond P. Pineault, both of Norwich, Conn.

[73] Assignee: The United States of America as represented by the Secretary of the Navy, Washington, D.C.

[21] Appl. No.: 08/933,559

[22] Filed: Sep. 19, 1997

[51] Int. Cl.[6] ..... H01R 13/58

[52] U.S. Cl. ..... 439/472; 439/445; 439/469

[58] Field of Search ..... 439/445, 472, 439/469, 473

[56] References Cited

U.S. PATENT DOCUMENTS

| | | | |
|---|---|---|---|
| 4,389,082 | 6/1983 | Lingaraju | 439/472 |
| 4,840,581 | 6/1989 | Leufert et al. | 439/472 |
| 5,178,559 | 1/1993 | Mello | 439/472 |
| 5,514,007 | 5/1996 | Rodrigues | 439/469 |

*Primary Examiner*—Paula Bradley
*Assistant Examiner*—Katrina Davis
*Attorney, Agent, or Firm*—Michael J. McGowan; Robert W. Gauthier; Prithvi C. Lall

[57] ABSTRACT

A mechanical strain relief for a cable is firmly attached directly to the housing of the connector to which the cable termination is plugged into. The strain relief has a split clamp aligned perpendicularly to the cable and extends from the housing sufficiently such that the clamp does not interfere with the use of a watertight rubber boot bonded to the housing to make the connector watertight. The clamp is opened and the cable is inserted into the connector. The clamp is then closed and tightened against the cable, such that any forces on the cable are transmitted through the strain relief to the housing. A guard extends from the strain relief and is shaped to loop around the cable to provide protection for the connector from foreign objects which would otherwise strike the termination or connector.

7 Claims, 2 Drawing Sheets

MECHANICAL STRAIN RELIEF

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to strain reliefs for cable connections and more particularly to a split design, clamping mechanism providing positive strain relief in a dynamic environment.

(2) Description of the Prior Art

Cable connections are susceptible to stress and damage whenever the connection is handled or the cable is pulled or twisted. In order to minimize this stress, various types of strain relief mechanisms are incorporated into the connections. U.S. Pat. No. 3,387,254 to Wheeler recites a device consisting of a continuous plastic belt which fits over the conductors extending from a conventional wall plug. The belt has slots on one end allowing the conductors to protrude past the plastic so that they be inserted into a wall receptacle. A metal strip is crimped over the other end of the belt and the cord to mechanically grip the cord at a position spaced from the plug end such that a small loop of cord is formed between the crimped end and the plug. When the cord is pulled, as when removing the plug from the receptacle, the belt transmits the forces on the cord to the plug housing. The device is not applicable to cables having large diameters which cannot be looped or those requiring a more secure method of attaching the strain relief device to the connector. U.S. Pat. No. 5,006,960 to Kallin et al. recites a somewhat similar strain relief method in that a loop in the cable provides strain relief for the connection. U.S. Pat. No. 4,863,396 to Johnson recites a strain relief clamp assembly having a female cylindrical component with a plurality of radially directed bearing access ports, a ball bearing and a biasing means. The inside surface of the female component has a concentric groove with an access channel to the outside surface. One side portion of a locking wire is inserted through the access channel. The clamp has a male compression ring component having a matching concentric groove on its outside surface for receiving the opposite side portion of the locking wire and further has a plurality of spaced apart ball bearing depressions. The male component is inserted into the female component and is locked thereto by the locking wire. Relative rotation between the female and male components is prevented by the female component ball bearing held in one of the male component depressions. The male component carries a clamp which is tightened about the wire bundle passing through the male component. Where rotation of one component relative to the other is not required, an assembly not having the complexity of the Johnson assembly would be advantageous. In some applications it is necessary for the cable connection to remain watertight. For example, outboard sensor housings in a marine environment typically have rubber boots bonded to the metal housing which surround the sensor cable connection when attached to the housing. Connector guards are provided adjacent the rubber boots to prevent foreign objects from striking and breaking the sensor cable connection. While positive locking plugs are used to ensure the sensor cable does not loosen from the housing, movement and twisting of the cable results in stressing the rubber to metal bond. Over time and repeated stress, this bond fails. Failure of the bond results in water entering the connection causing the sensor to fail.

SUMMARY OF THE INVENTION

Accordingly, it is an object of the present invention to provide a mechanical strain relief for a cable connection which does not require looping the cable.

Another object of the present invention is to provide a mechanical strain relief for a cable connection with a secure attachment to the cable.

Still another object of the present invention is to provide a mechanical strain relief for a cable having simple components.

A further object of the present invention is to provide mechanical strain relief for a watertight sensor cable connection.

A still further object of the present invention is to provide mechanical strain relief which incorporates a connector guard.

Other objects and advantages of the present invention will become more obvious hereinafter in the specification and drawings.

In accordance with the present invention, a mechanical strain relief for a cable is firmly attached directly to the housing of the connector which the cable termination is plugged into. The strain relief extends from the housing and has a split clamp aligned perpendicularly to the cable. The clamp extends away from the housing sufficiently such that the clamp does not interfere with the use of a watertight rubber boot bonded to the housing to make the connector watertight. The clamp is opened and the cable is inserted into the connector. The clamp is then closed and tightened against the cable, such that any forces on the cable are transmitted through the strain relief to the housing. The strain relief also includes a guard extending from the strain relief and shaped to surround approximately three-quarters of the cable. The guard prevents damage to the cable termination and connector from objects inadvertently striking the termination or connector.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
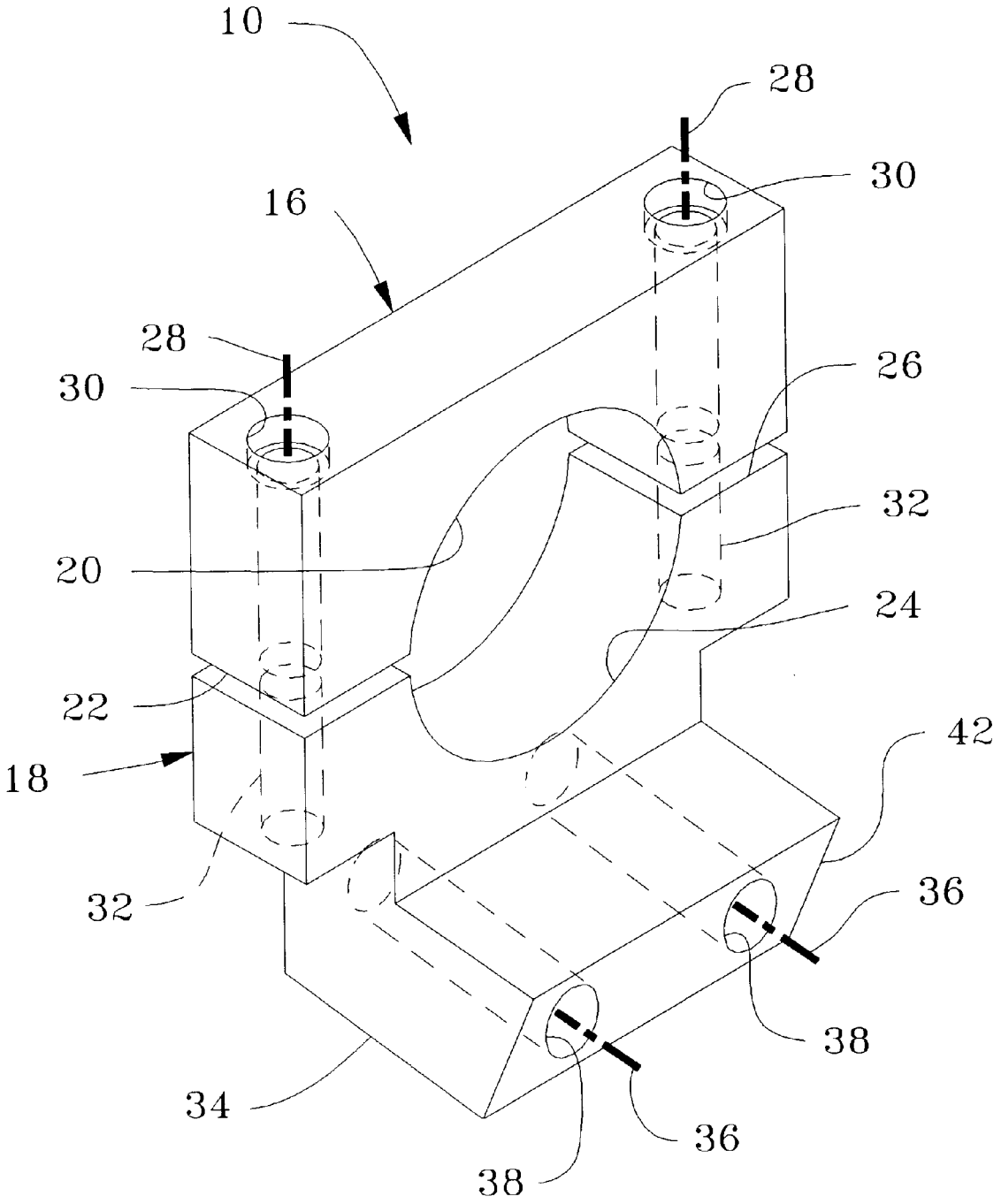
FIG. 1 is an isometric view of the mechanical strain relief of the present invention.
Figure 2:
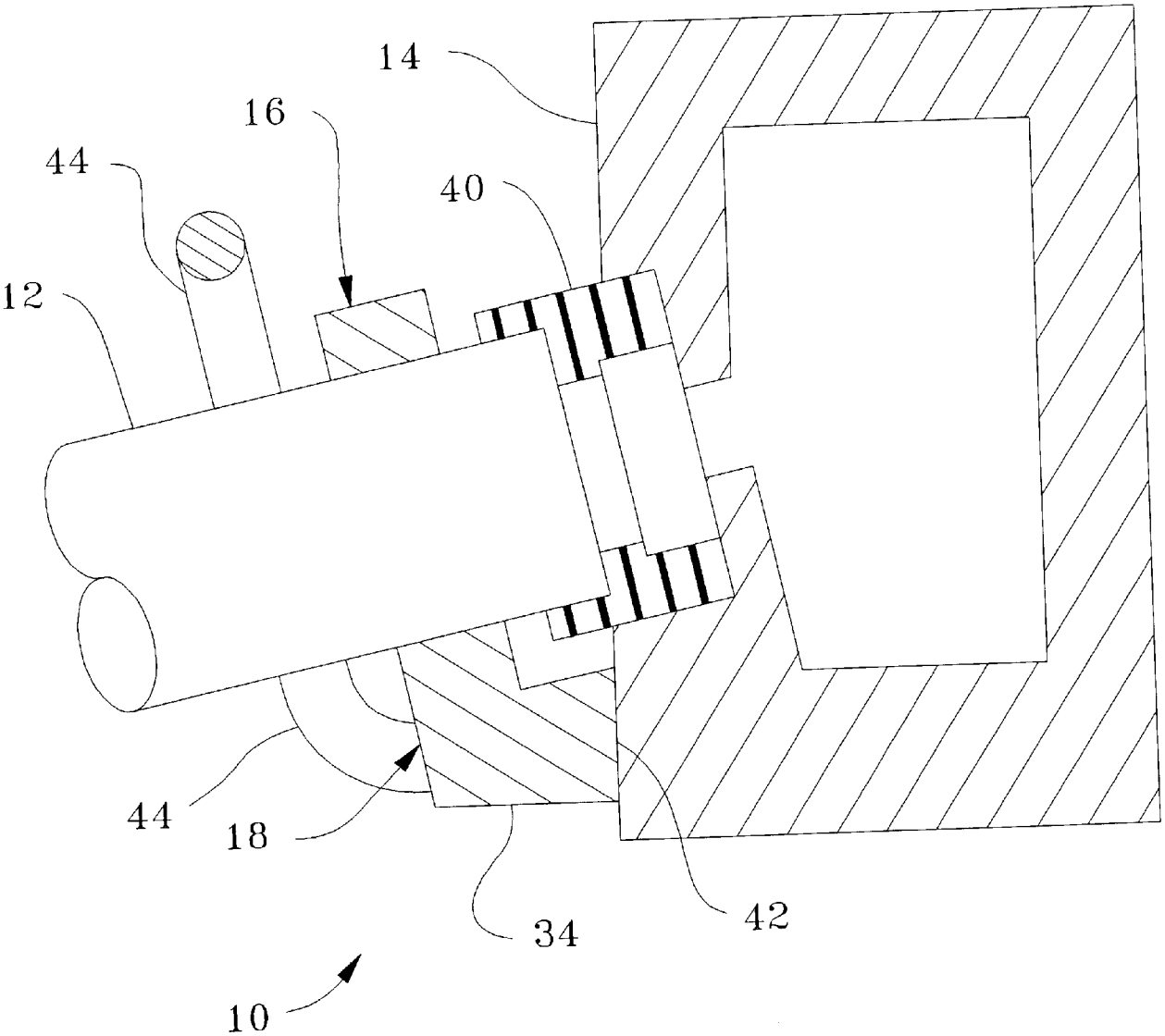
FIG. 2 is a partial cross sectional view of the mechanical strain relief of the present invention shown attached to a cable and connector housing.

Referring now to FIGS. 1 and 2, FIG. 1 shows an isometric view of a mechanical strain relief 10 of the present invention and FIG. 2 shows a partial cross section of strain relief 10 attached to a cable 12 and a connector housing 14. Strain relief 10 is of a split clamp design with a top portion 16 and bottom portion 18. Top portion 16 is in the shape of a thick rectangular plate having semicircular notch 20 cut into the edge 22 of top portion 16 facing bottom portion 18. Bottom portion 18 has a corresponding semicircular notch 24 on its edge 26 facing top portion 16 so as to form a circular opening when edges 22 and 26 are placed together. Top and bottom portions 16 and 18 are placed on opposite sides of cable 12 (not shown in FIG. 1) and are secured together using bolts 28 extending through countersunk bores 30 in top portion 16 and threaded into threaded bores 32 in bottom portion 18, firmly holding cable 12 between edges 22 and 26. Bottom portion 18 is an L-shaped thick plate, with the leg 34 extending in the general direction of cable 12. Bottom portion 18 is secured to connector housing 14 via bolts 36 passing through countersunk bores 38 on leg 34 and threaded into housing 14. Countersunk bores 38 are slotted to provide some adjustment in position strain relief 10 on housing 14. It can be seen from FIG. 2, that leg 34 is shaped such that top and bottom portions 16 and 18 are secured around cable 12 a distance away from housing 14. This allows strain relief 10 to secure cable 12 without interfering with watertight rubber boot connection 40. In fabricating bottom portion 18, the length of leg 34, the angle that leg 34 makes with bottom portion 18 and also the angle of face 42 of leg 34 are adjusted to suit housing 14 and cable 12 entry position. Strain relief 10 also includes guard rod 44 attached to bottom portion 18. Guard rod 44 (not shown in FIG. 1) extends from bottom portion 18, slightly below and on either side of cable 12 in a direction away from housing 14 and then loops over cable 12 to protect cable connection 40 from damage.

The invention thus described provides a mechanical strain for cable without requiring cable 12 to be looped. Cable 12 is held securely between top and bottom portions 16 and 18 and bottom portion 18 is securely attached to housing 14. Thus any stress on cable 12 is transferred through bottom portion 18 to housing 14. The L-shape of bottom portion 18 places the point at which the cable 12 is secured a distance away from the housing 14 and rubber boot connection 40. Thus when cable 12 is clamped between top and bottom portions 16 and 18, rubber boot connection 40 is not exposed to stress which would weaken the bond between rubber boot connection 40 and housing 14 leading to leakage of rubber boot connection 40. When housing 14 is towed outside of a vessel, guard rod 44 protects connection 40 from being struck and damaged by foreign objects.

Although the present invention has been described relative to a specific embodiment thereof, it is not so limited. Any means of securely attaching top and bottom portions 16 and 18 can be used, such as through bolts and nuts instead of bolts being threaded into bottom portion 18. Similarly, the attachment of bottom portion 18 to housing 14 may comprise threaded studs extending from housing 14, through leg 34 and secured with washers and nuts. Guard rod 44 may also have many shapes and methods of attachment to bottom portion 18, including being welded to bottom portion 18, or being separately attached to a bar which is then bolted to bottom portion 18.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A mechanical strain relief for a cable having a termination inserted into a connector of a housing, the strain relief comprising:

a first portion having a semicircular groove in a first end of the first portion;

a second portion having a corresponding semicircular groove in a mating end of the second portion;

a third portion affixed and extending from a second end of the second portion remote from the mating end, the third portion being secured to the housing and positioning the semicircular groove of the mating end over the cable at a point remote from the termination, the first end being placed over the cable opposite the second portion and secured to the mating end such that the cable is held firmly within the semicircular groove of the first end and the corresponding semicircular groove of the mating; and a guard extending from the strain relief and surrounding, in a spaced relationship, more than two thirds of the circumference of the cable, the guard serving to deflect objects from striking the termination and connector.

2. The strain relief of claim 1 wherein the first end is secured to the mating end by bolts passing through the first end and threaded into the mating end.

3. The strain relief of claim 1 wherein the third portion is secured to the housing by bolts passing through the third portion and threaded into the housing.

4. The strain relief of claim 1 wherein the guard is permanently affixed to the third portion of the strain relief.

5. The strain relief of claim 1 wherein the guard is removably secured to the third portion of the strain relief.

6. The strain relief of claim 1 wherein the guard comprises a rod, the rod is bent to surround the more than two thirds of the circumference of the cable.

7. A mechanical strain relief for a cable having a termination inserted into a watertight connector of a housing, the strain relief comprising:

a first portion secured to the housing and extending away from the housing in a direction generally parallel to a longitudinal axis of the cable;

a second portion affixed to the first portion and extending from the first portion in a direction generally perpendicular to the longitudinal axis of the cable, the second portion having a semicircular groove in a first end remote from the first portion, the semicircular groove being positioned over the cable at a point removed from the watertight connector;

a third portion having a corresponding semicircular groove placed over the cable opposite the semicircular groove of the second portion, the third portion being secured to the second portion to hold the cable firmly within the semicircular groove of the second portion and the corresponding semicircular groove of the third portion; and a guard extending from the strain relief and surrounding, in a spaced relationship, more than two thirds of the circumference of the cable, the guard serving to deflect objects from striking the termination and watertight connector.

* * * * *